US006238188B1

(12) United States Patent
Lifson

(10) Patent No.: US 6,238,188 B1
(45) Date of Patent: May 29, 2001

(54) COMPRESSOR CONTROL AT VOLTAGE AND FREQUENCY EXTREMES OF POWER SUPPLY

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/211,958

(22) Filed: Dec. 15, 1998

Related U.S. Application Data

(60) Provisional application No. 60/096,748, filed on Aug. 17, 1998.

(51) Int. Cl.[7] ..... F04B 49/00

(52) U.S. Cl. ..... 417/42; 417/19

(58) Field of Search ..... 417/42, 18, 22, 417/24, 25, 293, 279; 162/196, 196.1; 137/115.02, 115.01

(56) References Cited

U.S. PATENT DOCUMENTS 4,145,161 * 3/1979 Skinner ..... 417/22
4,330,237 * 5/1982 Battah .
4,335,582 * 6/1982 Shaw et al. ..... 62/196.1
4,486,148 * 12/1984 Battah ..... 417/2
4,912,932 * 4/1990 Malaker et al. ..... 62/6
4,946,350 * 8/1990 Suzuki et al. ..... 417/222.2
5,211,026 * 5/1993 Linnert ..... 62/175
5,362,210 * 11/1994 Richardson, Jr. ..... 417/307
5,419,146 * 5/1995 Sibik et al. ..... 62/115
5,603,227 * 2/1997 Holden et al. ..... 62/193
5,768,901 * 6/1998 Dormer et al. ..... 62/175
5,885,062 * 3/1999 Inoue et al. ..... 417/280
6,042,344 * 3/2000 Lifson ..... 417/310

* cited by examiner

*Primary Examiner*—Teresa Walberg
*Assistant Examiner*—Daniel Robinson
(74) *Attorney, Agent, or Firm*—Carlson, Gaskey & Olds

(57) ABSTRACT

A method is presented to prevent compressor damage by reducing compressor load when operating speed either is too low or too high as can be the case at extremes of line frequency and voltage. The speed of the compressor is deduced from the knowledge of compressor load, frequency and voltage. If the compressor speed is too high or too low for a given suction and discharge pressure, the compressor load is reduced to boost the operating speed or to reduce force acting on the bearings. The compressor load reduction may be achieved by actuating an unloader valve, a suction throttling device, or some other load reduction mechanism.

7 Claims, 2 Drawing Sheets

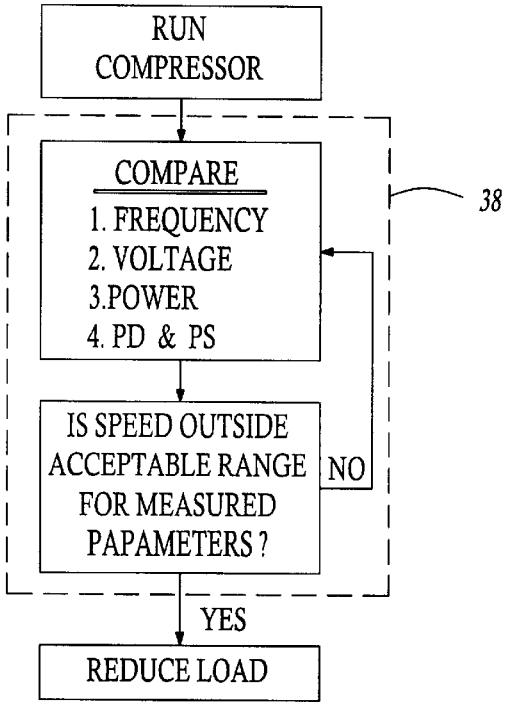
Fig-2
Fig-3
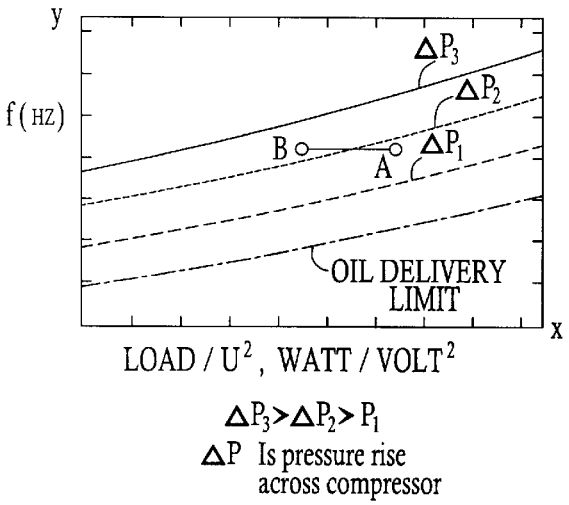
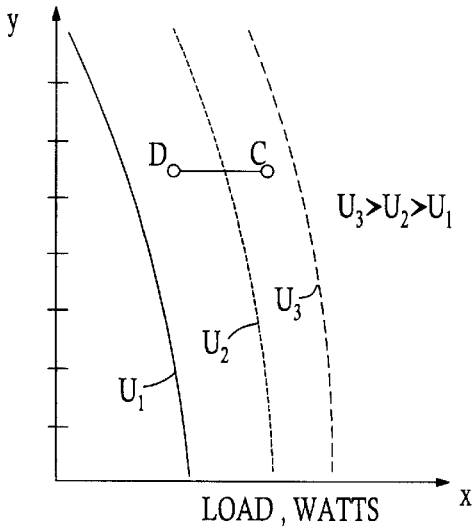
Fig-4

COMPRESSOR CONTROL AT VOLTAGE AND FREQUENCY EXTREMES OF POWER SUPPLY

This application claims benefit of Provisional Application 60/096,748 filed Aug. 17, 1998.

BACKGROUND OF THE INVENTION

The invention relates to a method for controlling compressor operation under extreme power supply conditions of line frequency and voltage.

Compressors are utilized in different refrigerant vapor compression applications, including refrigeration, air conditioning, heat pumps, etc. Typically, these compressors include an electric motor driving a compressor pump unit. The compressor pump unit compresses the refrigerant and delivers it into the refrigerant system.

For the compressor to operate property the compressor operating speed must fall within a certain range. The compressor speed is a function of the line frequency, voltage, and the load on the compressor. This can be explained as follows. The speed of the electrical motor used in typical refrigerant compressing applications is proportional to line frequency minus motor slip. The motor slip increases as supplied voltage is decreased or a compressor load is increased. Therefore, the compressor motor speed will decrease if the frequency decreases, if the load increases, or if the voltage decreases. Compressors are not designed to operate properly below a certain speed.

For example, scroll compressors may have a feature called radial compliance in which centrifugal force keeps an orbiting scroll pressed against fixed scroll in a radial direction. If the scroll compressor operates below a certain speed, the radial compliance can be lost, because centrifugal force keeping the scrolls together drops below the minimum acceptable value. Further, if an oil pump is employed, oil will not be delivered to lubricate scroll compressor components below a certain operating speed. These are undesirable effects of operating scroll compressor at reduced speed.

The overall force acting on a main scroll compressor bearing consists of two components. The first component of the force is proportional to compressor load; and the second component, caused by rotating shaft counterweights, is proportional to speed squared. Thus, as speed increases to an undesirably high level at a given compressor load, the overall force acting on the bearing can become excessively high, which is undesirable. Then, to decrease the force acting on the bearing the compressor speed must be decreased or compressor load decreased.

The operation under extreme conditions of line frequency and voltage and resultant operating speed excursions are especially common where the electric power is supplied by a generator set, since in this application frequency and voltage often fluctuate extensively, especially on start up.

SUMMARY OF THE INVENTION

In the disclosed embodiment of this invention, line frequency and voltage, as well as compressor suction and discharge pressure are monitored. If the line frequency or voltage is such that the compressor speed is not within a target range for a measured pressure rise across the compressor, then the compressor load is decreased to adjust the operating speed or force acting on the bearings. Of course, variables other than line frequency or voltage could be monitored. As an example, the motor speed could be monitored directly. However, this approach is often difficult, as it requires installation of a dedicated speed sensing transducer.

If the compressor speed is below the target value, which may occur if the line frequency or voltage are undesirably low, then the compressor load is decreased. This would, in turn, boost the compressor speed. The compressor speed will then move within, or at least towards, an acceptable range. The load can be reduced, for example, by engaging an unloader valve, shutting off an economizer line or throttling a suction modulation valve, either independently or in combination with each other.

As the load is reduced, the motor slip is reduced and the speed will increase, even though the line frequency or voltage have not changed and are still below the desired value.

On the other hand, if the line frequency is too high then the compressor speed may exceed the specified value. The load is again reduced by engaging the compressor unloader mechanism. By performing this compressor load reduction, the force on the bearings is reduced and bearing overload due to over speeding is avoided.

These and other features of the present invention can be best understood from the following specification and drawings, the following of which is a brief description.

BRIEF DESCRIPTION OF THE DRAWINGS

FIG. 2 is a flow chart of the present invention.

FIG. 3 shows limiting values of frequency during low speed operation.

FIG. 4 shows limited values of frequency during high speed operation.

DETAILED DESCRIPTION OF A PREFERRED EMBODIMENT

Figure 1:
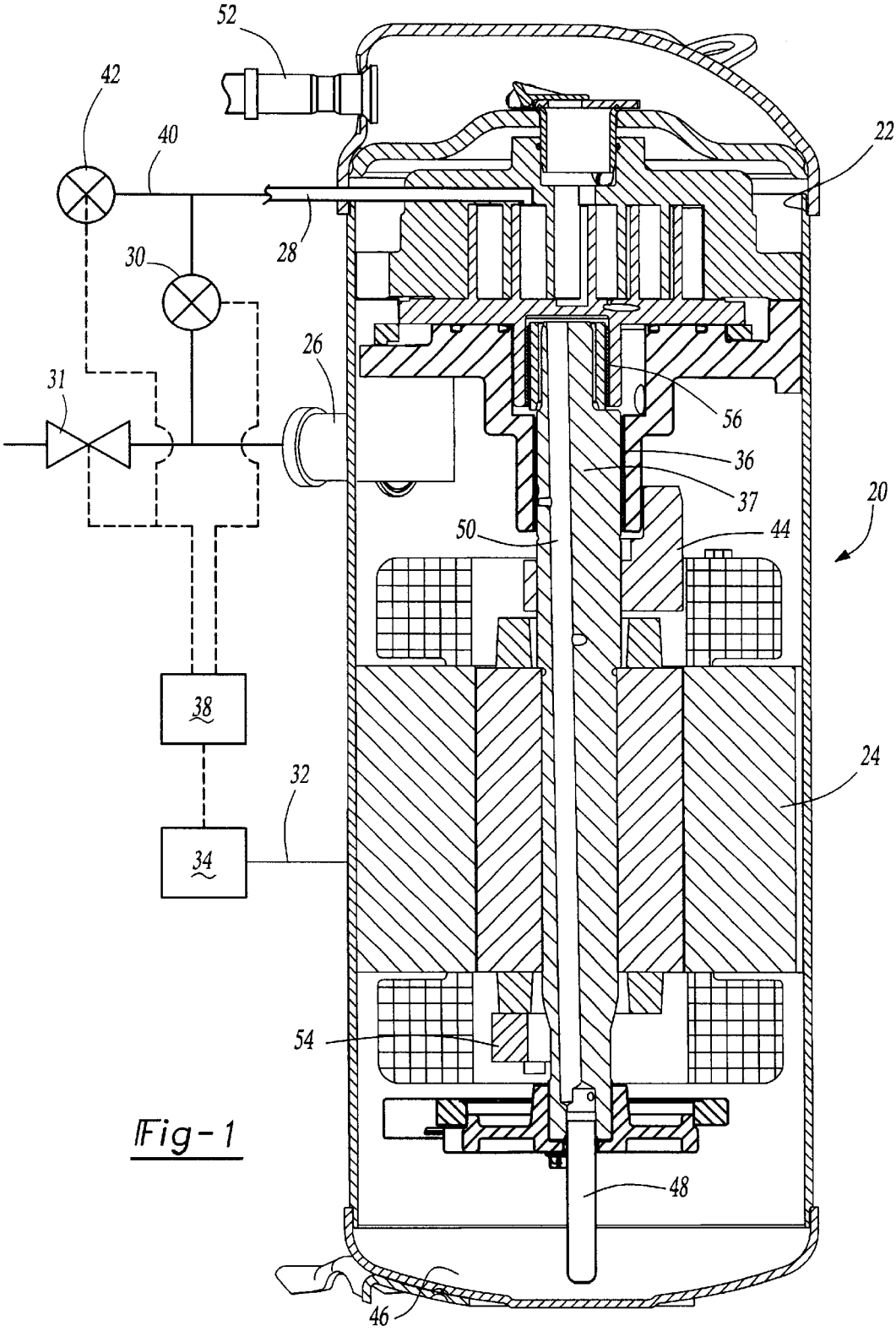
FIG. 1 is a schematic view of a compressor and motor incorporating the present invention.

A compressor 20 as shown in FIG. 1 is a scroll compressor and includes a pump unit 22 and a motor 24. The pump unit 22 is shown as a combination of a fixed and an orbiting scroll. It also should be understood that the inventive method and system of this invention would extend to other type compressors.

As known, the compressor pump unit 22 receives a refrigerant to be compressed from a suction line 26. In the system shown in FIG. 1, an economizer injection line 40 supplies an economizer fluid, as known. An intermediate pressure chamber within the pump unit 22 will typically receive refrigerant from the economizer injection port 28.

An unloader valve 30 is shown communicating economizer injection line 28 to suction line 26. This invention is better described in co-pending patent application Ser. No. 09/114,395 filed Jul. 13, 198 and entitled "Unloader Valve Between Economizer and Suction Line". Although this particular unloader valve is shown in this application, it should be understood that other unloader valves can be utilized to achieve the load reduction of this invention. As for example, the unloader valve can be installed independently of the economizer line.

A suction modulation valve 31 is mounted on the suction line 26 and acts to throttle the flow of refrigerant to suction line 26 connected to the inlet of compressor 20 as known. By throttling flow of refrigerant to the compressor, the load on the compressor is regulated by reducing the amount of supplied refrigerant. If compressor is operated in an economized mode, then the load on the compressor can be reduced by shutting off or throttling valve 42, located in the economizer line 40.

A power supply line 32 is shown delivering power to the motor 24 from power supply 34. One common type of supply would be a generator set that will especially benefit from this invention. Generator sets are prone to produce frequency and voltage which often fall outside normal operating limits.

A control 38 is shown as a black box and monitors the frequency and voltage of power supply on the line 32. It also monitors suction pressure in line 26 and discharge pressure in discharge line 52. The control 38 also controls the suction modulation valve 31, the unloader valve 30, and economizer valve 42. It should be understood that the control 38 may be the microprocessor control for the entire refrigerant system, and would typically provide functions and operations beyond that of this invention. For simplicity, the control 38 will only be described here as performing the functions which are part of this invention.

If the above mentioned parameters monitored by the control 38 indicate that the compressor speed would be below a target value, then the control 38 reduces the compressor load to increase the compressor speed. This decrease in load can be performed by actuating either the unloader valve 30, the suction modulation valve 31, actuating them both together, by shutting off economizer valve 42 or by some other way of reducing load. It is the reduction of the load that results in an increase in the speed of the pump at a given power supply condition and at a given suction and discharge pressure which is the goal of this invention. Thus, when the control 38 determines that the speed is to fall below an acceptable value, it reduces the compressor load. This then results in the speed increasing as the load has decreased. The minimum acceptable frequency of the power supply can be determined from the FIG. 3, wherein minimum acceptable frequency is indicated on "Y" axis for a given ratio of compressor power over voltage squared, indicated on "X" axis. Please note that the origin of the X-Y coordinate system is chosen to correspond to some finite value of frequency, f, and load/$U^2$. The minimum acceptable frequency should be located above a line indicated by certain pressure rise across the compressor (discharge pressure minus suction pressure).

Let us consider a case showing how the unacceptable operation due to operation at low operating speed can be rectified by taking corrective unloading actions. Let us assume that the compressor is operating at point A, as indicated in FIG. 3. The location of the point A on the graph is determined from the knowledge of compressor load (power), and line voltage U and frequency f. Let us also assume that at this point A the pressure rise (PD-PS) across the compressor is equal to $\Delta P3$. According to the graph of FIG. 3, this results in unacceptable operation, since point A is located well below the line of constant $\Delta P3$. To correct the situation the compressor load is decreased (while frequency and voltage remain the same), which results in moving the point A to a new position of point B. If the compressor load reduction also resulted in decrease in pressure rise across the compressor to a value of $\Delta P2$, then the operation of the compressor becomes acceptable as the new point is located above the line of constant $\Delta P2$.

There is also minimum acceptable frequency which would be required to deliver oil from oil sump 46 through an oil pick up tube 48 and oil delivery passage 50 to bearing 36 and bearing 56. This line is independent of pressure rise across the compressor and is also shown in FIG. 3.

Let us consider a case, as shown in FIG. 4, which illustrates how unacceptable operation due to high operating speed can be rectified by taking corrective unloading actions without damaging bearings due to excessive speed. Please note the origin of the X-Y coordinate system in FIG. 4 is chosen to correspond to some finite values of frequency, f, and load. Let us assume that the compressor is operating at point C. The location of point C on the graph is determined from the knowledge of compressor Load (Power) and line frequency, f. Let us also assume that while operating at this point, the line voltage is U2. As can be seen from the graph, this is unacceptable because point C is located to the right of constant voltage U2. To correct the situation the compressor load is decreased, which results in moving the point C to a new position of point D. The point D is now located to the left of line of constant voltage U2, which is now acceptable operation. Thus, by decreasing the load on the compressor, the force acting on bearing 36 due to rotating counterweights 44 and 54 installed on shaft 37 is reduced. Therefore, there is less likelihood of bearing damage when the compressor is operating at high speed.

Control 38 is programmed to include the information from at least FIG. 3 and perhaps FIG. 4. The graphs of FIGS. 3 and 4 are determined either experimentally or analytically.

A simplified operation flow chart for operating compressor 20 at extremes of line frequency and voltage is shown in FIG. 2. The control 38 controls the compressor operation and monitors the indicated parameters. If an extreme condition is identified that would likely result in the speed of the compressor being outside of an acceptable range, then the compressor load is reduced. If the speed is still outside the acceptable range after the first stage of unloading is engaged, then additional unloading steps are undertaken. If the monitored parameters indicate that the speed is within an acceptable range, then the system continues to operate at full load.

A preferred embodiment of this invention has been disclosed, however, a worker of ordinary skill in this art would recognize that certain modifications come within the scope of this invention. For that reason, the following claims should be studied to determine the true scope and content of this invention.

What is claimed is:

1. A method of operating a compressor comprising the steps of:

(1) providing an electric motor for driving a compressor, and a control for monitoring a characteristic indicative of the speed of the compressor as driven by said electric motor;

(2) operating said compressor and monitoring a characteristic indicative of the speed of said compressor; and (3) reducing a compressor load if the monitored speed is outside of a predetermined range.

2. A method as recited in claim 1, wherein a control for said system monitors the characteristics of a power supply and the operating conditions of said compressor, and reduces said load in step (3) when it is determined that the speed of the compressor is outside said range.

3. A method as set forth in claim 1, wherein the load reduction is accomplished by actuating an unloader valve.

4. A method as set forth in claim 1, wherein the load reduction is achieved by throttling a suction throttling device.

5. A method as set forth in claim 1, wherein the load reduction is achieved by throttling or shutting off a valve in the economizer line.

6. A method as set forth in claim 1, wherein the load reduction is achieved by simultaneously throttling at least two of a suction throttling device, an unloader valve, and an economizer line value.

7. A method as set forth in claim 1, wherein said range includes both upper and lower limits.

* * * * *